US009732919B2

(12) United States Patent
Ip

(10) Patent No.: US 9,732,919 B2
(45) Date of Patent: Aug. 15, 2017

(54) MULTIFUNCTIONAL MODULE-TYPE LIGHT

(71) Applicant: Chinolite (HK) Limited, Hong Kong (HK)

(72) Inventor: Pok Sum Ip, Hong Kong (HK)

(73) Assignee: Chinolite (HK) Limited, Hong Kong (HK)

( * ) Notice: Subject to any disclaimer, the term of this patent is extended or adjusted under 35 U.S.C. 154(b) by 0 days.

(21) Appl. No.: 15/207,479

(22) Filed: Jul. 11, 2016

(65) Prior Publication Data

US 2016/0320006 A1 Nov. 3, 2016

Related U.S. Application Data

(63) Continuation of application No. PCT/CN2015/079833, filed on May 26, 2015.

(30) Foreign Application Priority Data

May 27, 2014 (CN) ..... 2014 2 0275988 U

(51) Int. Cl.

| | |
|---|---|
| ***F21S 4/00*** | (2016.01) |
| ***F21V 21/00*** | (2006.01) |
| ***F21S 2/00*** | (2016.01) |
| ***F21V 21/14*** | (2006.01) |
| ***F21V 29/76*** | (2015.01) |
| ***F21V 3/00*** | (2015.01) |

(Continued)

(52) U.S. Cl.

CPC ..... *F21S 2/005* (2013.01); *F21S 2/00* (2013.01); *F21V 3/00* (2013.01); *F21V 21/14* (2013.01);

(Continued)

(58) Field of Classification Search

CPC .. F21S 2/005; F21V 29/76; F21V 3/00; F21V 21/30

(Continued)

(56) References Cited

U.S. PATENT DOCUMENTS 6,032,432 A * 3/2000 Patti ..... F21V 15/013 29/428
7,789,544 B1 * 9/2010 Roach ..... B60Q 1/0483 362/370

(Continued)

FOREIGN PATENT DOCUMENTS

CN 203413451 U 1/2014
CN 203586123 U 5/2014

OTHER PUBLICATIONS

International Search Report of PCT Patent Application No. PCT/CN2015/079833 issued on Sep. 10, 2015.

*Primary Examiner* — Bryon T Gyllstrom

(57) ABSTRACT

A multifunctional module-type light includes a light-emitting module and a supporting assembly. The light-emitting module includes at least one LED module, and a plurality of the LED modules is connected via a connecting assembly. The supporting assembly includes a supporting frame and a positioning assembly. The supporting frame is installed on the light-emitting module in the manner that the angle thereof is adjustable via the positioning assembly, and the supporting frame has installation feet for connecting the light-emitting module and a supporting plate for connecting the two installation feet. The supporting plate has a flat surface or an inclined surface, and the light-emitting module is secured on a surface via the supporting plate. Such multifunctional module-type light uses a modularized designed unit structure, which breaks the power constraints that a conventional lamp has only a single-housing.

18 Claims, 7 Drawing Sheets

(51) Int. Cl.
*F21V 21/30* (2006.01)
*F21Y 115/10* (2016.01)
*F21W 131/10* (2006.01)

(52) U.S. Cl.
CPC ..... *F21V 21/30* (2013.01); *F21V 29/76* (2015.01); *F21W 2131/10* (2013.01); *F21Y 2115/10* (2016.08)

(58) Field of Classification Search
USPC ..... 362/249.02
See application file for complete search history.

(56) References Cited

U.S. PATENT DOCUMENTS

| | | | | |
|---|---|---|---|---|
| 8,708,535 | B2 * | 4/2014 | Dalsgaard | F21V 21/30 362/249.1 |
| 8,789,978 | B2 * | 7/2014 | Tickner | F21S 8/02 362/294 |
| D767,806 | S * | 9/2016 | Colacilli | D26/63 |
| 2009/0196037 | A1 * | 8/2009 | Xiao | F21V 21/30 362/249.03 |
| 2011/0075409 | A1 * | 3/2011 | Zheng | F21S 8/033 362/231 |
| 2011/0235330 | A1 * | 9/2011 | Pedersen | F21V 21/30 362/249.03 |
| 2011/0317419 | A1 | 12/2011 | Huang | |
| 2013/0027935 | A1 * | 1/2013 | Ladewig | F21S 2/00 362/249.01 |

* cited by examiner

MULTIFUNCTIONAL MODULE-TYPE LIGHT

CROSS-REFERENCE TO RELATED APPLICATIONS

The present application is a Continuation Application of PCT application No. PCT/CN2015/079833 filed on May 26, 2015, which claims the benefit of Chinese Patent Application No. 201420275988.8 filed on May 27, 2014; the contents of which are hereby incorporated by reference.

TECHNICAL FIELD

The present application relates to the technical field of lighting devices, and in particular to a multifunctional module-type light which can be combined arbitrarily.

BACKGROUND

With the continuous development of LED technology, LED lamps gradually replace the traditional incandescent lamps and halogen lamps. LED lamps have many advantages, and so manufacturers are committed to the development of such LED lamps. Especially for outdoor lighting where large illuminated area and wide light source are required, using the traditional lighting will consume a lot of energy. Thus, making use of LED lighting is the current trend of development.

Although an LED lamp has certain advantages, there are some problems need to be solved:

1. Product design is problematic. At present LED lighting products usually adopt one-to-one design. That is, one lamp housing can only produce lighting products of a specific power range. If one needs to develop a series of lighting products, one needs to design a series of different lamp housings. Development cost becomes very high.
2. Heating is a problem because LED lights use LED light panels of high power as the light source. The large amount of heat, if not timely dissipated, can easily lead to overheating of the LED light, thereby affecting the normal operation of the light. It will also lead to expansion and contraction, causing product sealing and water leakage problems.
3. Light projection area and projection angle are to be concerned. The structure of a traditional LED light is an overall design, and cannot be combined arbitrarily.

Under different environments, different LED lightings require different light projection areas, and LED lightings having only one standard apparently cannot meet the needs of the modern society. For example, LED street lights for a main road require greater outdoor brightness and wider illumination. On the other hand, small pedestrian streets require smaller outdoor brightness and narrower illumination. However, street lights of different design specifications need new design and development of different molds and different circuit structures. These increase manufacturing costs because lights with different specifications require different mold productions and assembly parts.

Aiming at the above problems, the present application provides an improved multifunctional module-type light.

SUMMARY

The technical problem to be solved in the present application is to overcome the shortcomings, and provide a multifunctional module-type light.

In order to solve the technical problems, this application uses the following technical scheme. According to one aspect, there is provided a multifunctional module-type light including a light-emitting module and a supporting assembly, wherein the light-emitting module includes at least one LED module, a plurality of the LED modules being connected via a connecting assembly, the supporting assembly including a supporting frame and a positioning assembly, wherein the supporting frame is installed on the light-emitting module in a manner that an angle thereof is adjustable through the positioning assembly, the supporting frame includes two installation feet connecting with the light-emitting module and a supporting plate connecting between the two installation feet, the supporting plate in a first embodiment and a second embodiment comprises a flat surface, and the supporting plate in a third embodiment and a fourth embodiment comprises a slanted surface, and the light-emitting module is fixed on a surface through the supporting plate.

In one embodiment, each LED module includes a heatsink, a light-transmitting cover fixed on the heatsink, a driving device and an LED light panel, the heatsink including a mounting surface and a plurality of heat-dissipating fins formed on the mounting surface, and the light-transmitting cover being formed thereon with a plurality of reflectors to meet light distribution requirements in different angles.

In one embodiment, the light-emitting module includes one independent LED module, wherein the support frame is disposed across the heatsink of the LED module, and the two installation feet of the supporting frame are installed on the heat-dissipating fins at two sides of the heatsink in a manner that an angle thereof is adjustable through the positioning assembly.

In one embodiment, the light-emitting module is formed of a plurality of LED modules parallel connected in a horizontal plane, wherein rows of the LED modules are connected by the connecting assembly, and columns of the LED modules are connected by the driving devices provided on the heatsinks.

In one embodiment, the connecting assembly is in the form of a plurality of connecting rods, wherein each connecting rod is fixed on an outermost heat-dissipating fin of the heatsink on one side of each LED module through a bolt, two ends of the drive device are respectively connected to the heat-dissipating fins of the LED module by connecting pieces, and the LED modules are connected at a certain angle with respect to each other through the connecting rods.

In one embodiment, the positioning assembly includes a positioning disk formed with a plurality of positioning grooves, and fixed on an upper surface of the light-emitting module.

In one embodiment, the supporting frame is installed on the heat-dissipating fins of the LED module, and the positioning disk is fixed on the heat-dissipating fins, and the supporting feet of the supporting frame are fixed on the heat-dissipating fins through a plurality of bolts.

In one embodiment, the supporting frame is installed on corresponding connecting rods and the positioning disk is fixed on the connecting rods, and the supporting feet of the supporting frame are fixed on the connecting rods through a plurality of bolts.

In one embodiment, the supporting plate of the supporting frame is formed with at least one installation hole, and is fixed on a horizontal surface by at least one screw.

Adopting the above-mentioned technical scheme and comparing with the existing technology, the multifunctional module-type light of the present application has the following advantages:

1. Using modular units, breakthrough of power restriction in a conventional lamp with a single housing can be achieved. In conventional lighting products, design of a lamp housing can only produce lighting products having only a specific power range. Therefore, in order to develop a series of lighting products, one needs to produce a variety of housing designs, and the development cost is very high. The present application uses modular design structure, so that a light-emitting module can be formed by combining a plurality of independent LED modules through connecting pieces. One can select the appropriate number of LED modules according to the need of the environment so that it can form lighting of different specifications to suite different environments. The design of the modularization structure not only saves the production cost, each module can be conveniently disassembled and maintenance cost can be also saved.
2. Light distribution curve and projection angle can be adjusted. For conventional lighting products, a lighting product of one model usually has only one light distribution curve and projection angle. Some lighting devices can adjust the projection angle through a supporting frame. However, a lighting product of one model only has one light distribution curve. Different illuminating environments need different light distributions. This leads to a great problem in lighting design. In this application, the multifunctional module-type light is innovative in that each module has angle and positioning adjustment within a certain range. The supporting frame and connecting assembly are provided with angle-adjusting function. The supporting frame can be installed on a light-emitting module through a supporting assembly in order to adjust the angle. LED modules are connected by connecting rods. One can adjust the angle of projection of each module in the whole lighting device, so as to achieve a lighting device having many light distribution curves. With the projection angle adjustment on the supporting frame, a lighting product of the same model can meet different environment lighting needs. This can greatly simplify the lighting design.
3. Size and weight of high-power lighting devices can be reduced. For conventional high-power lighting products, in order to meet the three aspects of need, namely, light distribution, heat dissipation, and built-in driver, the size and weight of the lighting housing are increased. However, increase in size and weight will cause great inconvenience in installation. The need for more investment in human resources, tests on installation position and space, and load-bearing capacity would waste installation cost. Especially in outdoor installation under the effect of wind, weight and other external force, safety requirement of lighting devices is higher, size and weight of lighting device are greater, and there will be more hidden safety issues. The innovation of the multifunctional module-type light of the present application lies in the unique combination of light-emitting modules and power supply modules. This greatly reduces the size and weight of the lighting device, and makes installation more convenient as the size and weight reduce, the effect of external force reduces accordingly, and potential safety hazard reduces accordingly.
4. Modular design reduces maintenance cost. For conventional lighting products, the whole lighting device is sealed. When a part of the whole lighting device is broken, the whole lighting device needs to be disassembled for maintenance. Thus, maintenance cost is very high. The innovation of the multifunctional module-type light of the present application lies in the modularization of light-emitting modules and power supply modules. When a part is broken, one only needs to disassemble the connecting assembly and only replaces the broken module. There is no need to disassemble the whole lighting device for maintenance. This can greatly reduce the maintenance cost.
5. The multifunctional module-type light of the present application can be used to meet the needs of different outdoor locations such as advertising lighting, regional lighting, sports lighting, building accent lighting, road lighting and other outdoor locations.

ILLUSTRATION OF REFERENCE SIGNS IN DRAWINGS

Figure 1:
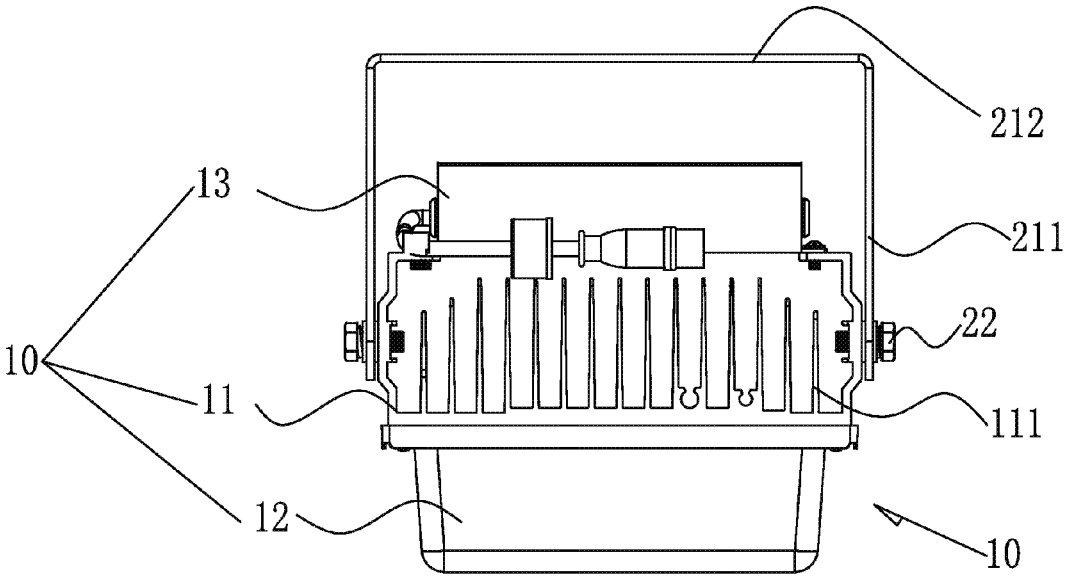
FIG. 1 is a front view of the first embodiment of the present application.

1 light-emitting module, 10 LED module, 11 heatsink

111 heat-dissipating fin, 12 light-transmitting cover, 13 driving device

2 supporting assembly, 21 supporting frame, 211 installation feet

212 supporting plate, 213 installation hole, 214 connecting plate

22 positioning assembly, 221 positioning disk, 222 positioning groove

3 connecting assembly

DETAILED DESCRIPTION

The present application is further illustrated by the following specific embodiments and the accompanying drawings.

Figure 2:
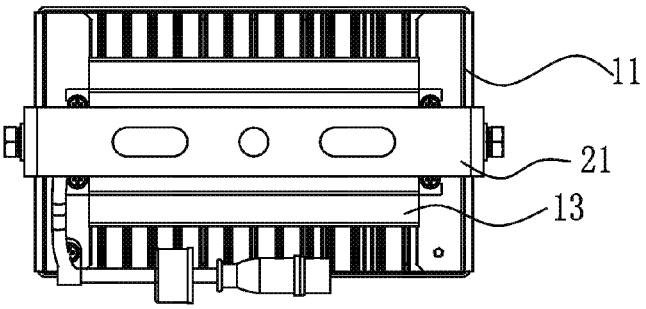
FIG. 2 is a top view of the first embodiment of the present application.
Figure 3:
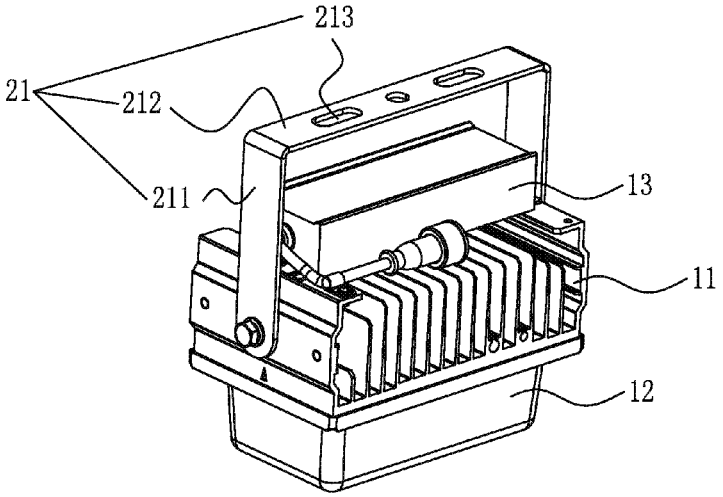
FIG. 3 is a perspective view of the first embodiment of the present application.

First Embodiment:

FIGS. 1-3 show a multifunctional module-type light which may include a light-emitting module 1 and a supporting assembly 2. The light-emitting module 1 may include an independent LED module 10. The LED module 10 may include a heatsink 11, a light-transmitting cover 12 mounted on the heatsink 11, a driving device 13, and an LED light panel. The light-transmitting cover 12 may be formed thereon with a plurality of reflectors to meet light distribution requirements in different angles. The supporting assembly 2 may include a supporting frame 21 and a positioning assembly 22. The supporting frame 21 may be installed on the light-emitting module 1 in a manner that an angle thereof can be adjustable through the positioning assembly 22.

The supporting frame 21 may include two installation feet 211 connecting with the light-emitting module 1 and a supporting plate 212 connecting between the two installation feet 211. The supporting plate 212 may have a flat surface. The LED module 10 can be fixed on a surface through the supporting plate 212 of the supporting frame 21.

Specifically, the heatsink 11 may include a mounting surface and a plurality of heat-dissipating fins 111 formed on the mounting surface. The supporting frame 21 may be mounted on the heatsink 11 of the LED module 10 through the positioning assembly 22.

Figure 11A:
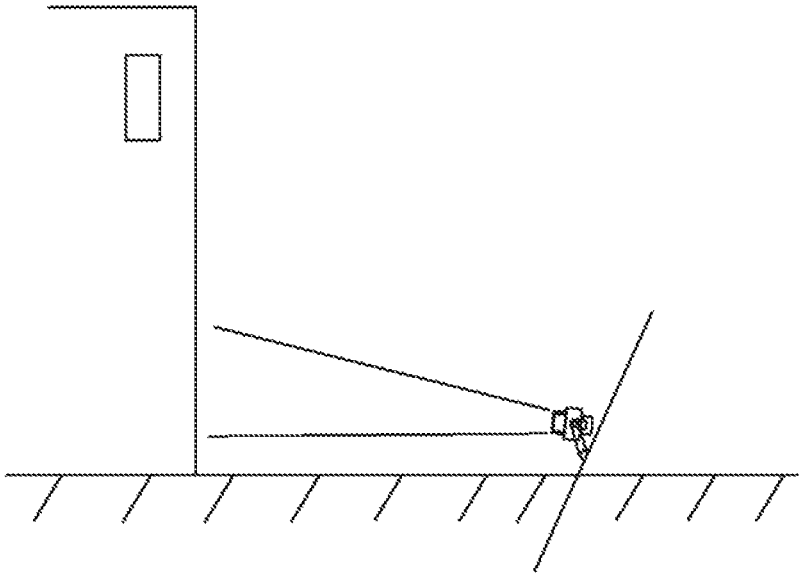
FIGS. 11A-11B are schematic diagrams of the illumination angle of the present application.
Figure 11B:
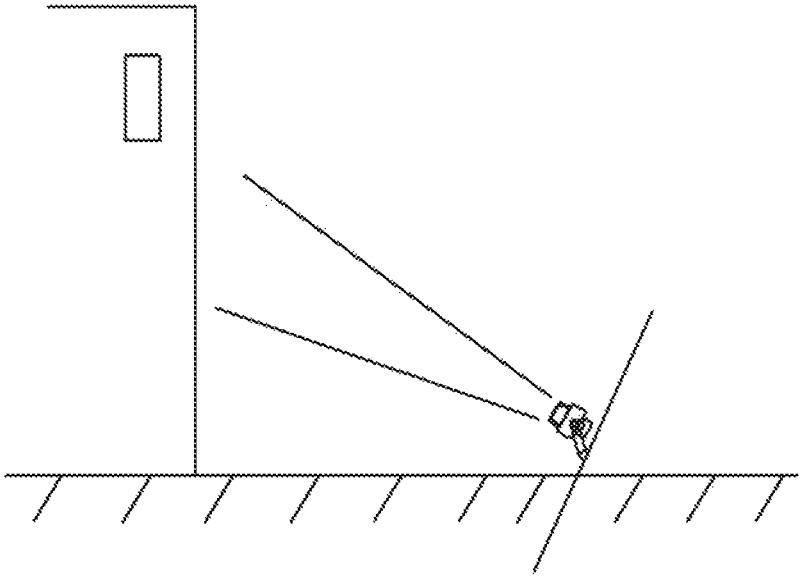
Figure 12A:
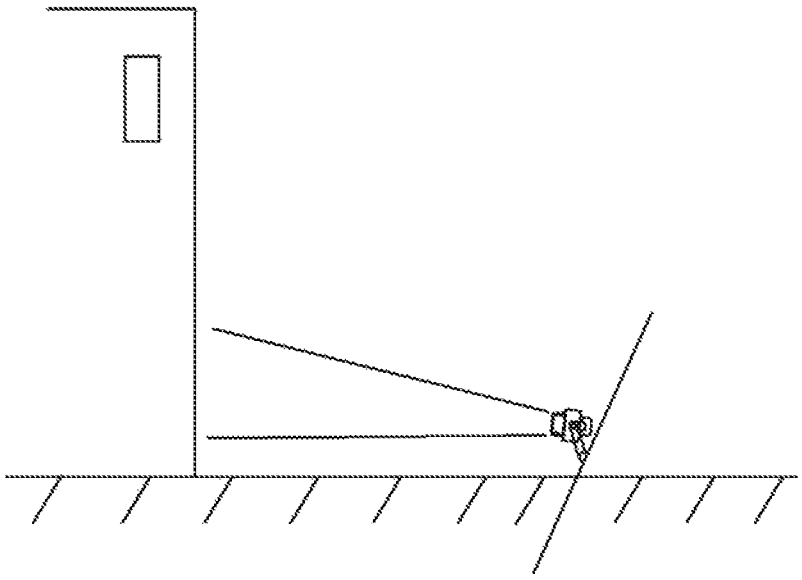
FIGS. 12A-12B are schematic diagrams of the range of illumination of the present application.
Figure 12B:
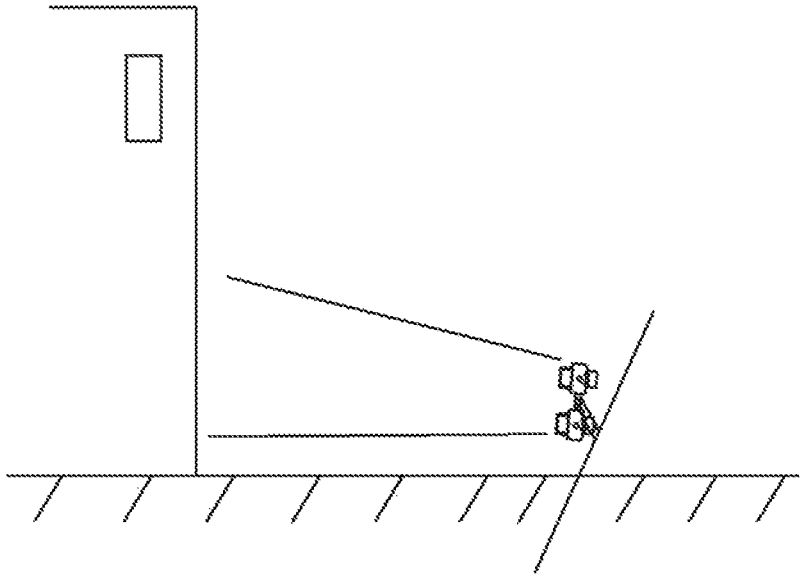

When in use, the supporting plate 212 of the supporting frame 21 is in close contact with a flat surface. Screws are passed through the installation holes 213 on the supporting plate 212 to thereby fix the LED module 10 on the flat surface through the supporting frame 21. As shown in FIGS. 11A-11B, the angle between the LED module 10 and the supporting frame 21 can be adjusted according to the area that requires illumination. The LED module 10 can be rotated upwards so that the angle between the LED module 10 and the horizontal ground gradually increases. By adjusting the illumination angle of the LED module 10, the LED module 10 can direct light to a certain height.

Figure 4:
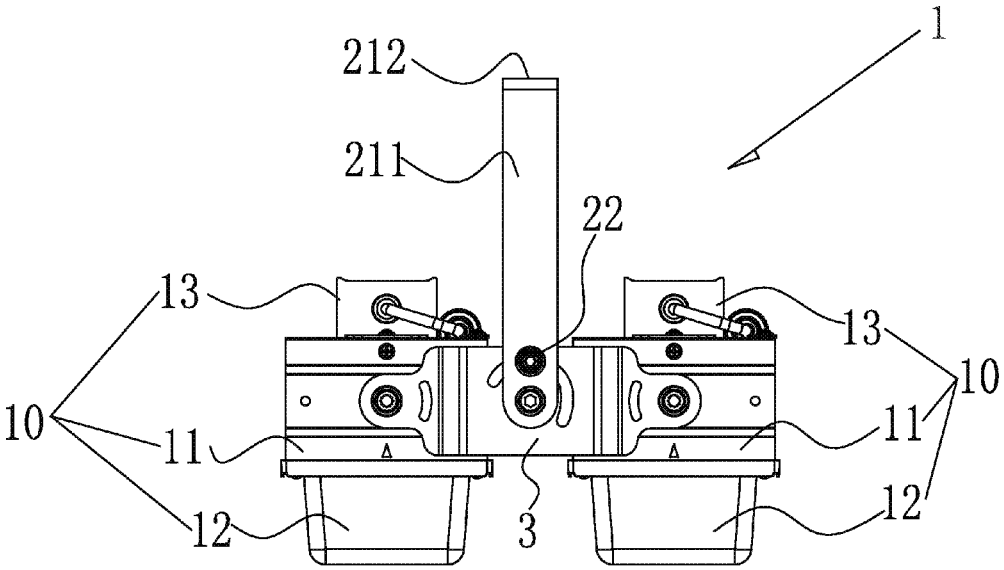
FIG. 4 is a side view of the second embodiment of the present application.
Figure 5:
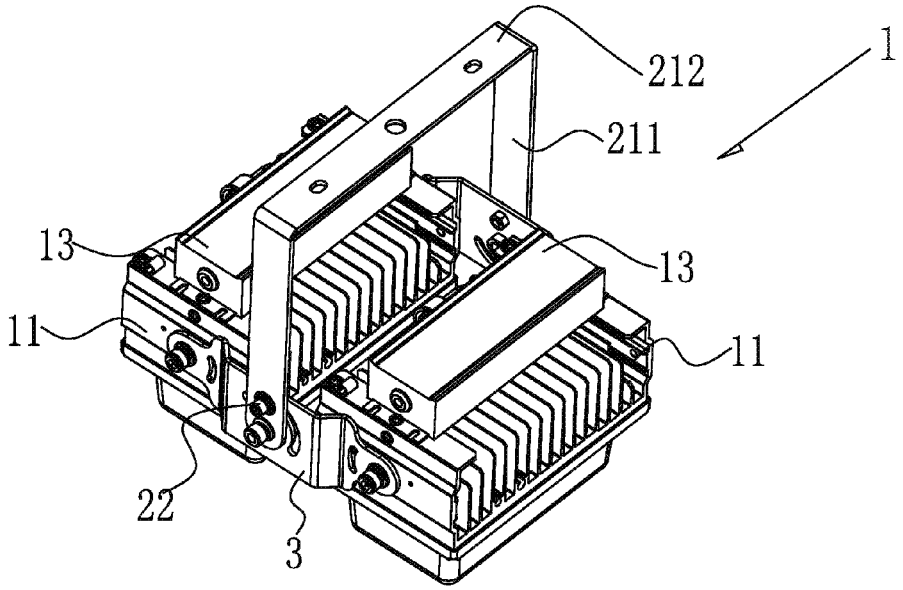
FIG. 5 is a perspective view of the second embodiment of the present application.

Second Embodiment:

FIGS. 4-5 show a multifunctional module-type light which may include a light-emitting module 1 and a supporting assembly 2. The light-emitting module 1 may include a plurality of mutually independent LED modules 10. Two LED modules 10 are provided here. The two LED modules 10 can be connected by a connecting assembly 3. Each LED module 10 may include a heatsink 11, a light-transmitting cover 12 fixed on the heatsink 11, a driving device 13, and an LED light panel. The light-transmitting cover 12 may be formed thereon with a plurality of reflectors to meet light distribution requirements in different angles. The supporting assembly 2 may include a supporting frame 21 and a positioning assembly 22. The supporting frame 21 may be installed on the light-emitting module 1 in a manner that an angle thereof can be adjustable through the positioning assembly 22. The supporting frame 21 may include two installation feet 211 connecting with the light-emitting module 1 and a supporting plate 212 connecting between the two installation feet 211. The supporting plate 212 may have a flat surface. The light-emitting module 1 can be fixed on a surface through the supporting plate 212 of the supporting frame 21.

Specifically, the heatsink 11 may include a mounting surface and a plurality of heat-dissipating fins 111 formed on the mounting surface. Heat-dissipating channels may be formed between the heat-dissipating fins 111. The two LED modules 10 can be connected with each other, and aligning heat-dissipating channels can be in communication with each other. The connecting assembly 3 may be in the form of a plurality of connecting rods. Each connecting rod may be fixed on an outermost heat-dissipating fin 111 of the heatsink 11 on one side of each LED module 10 through a bolt. The LED modules 10 may be connected at a certain angle with respect to each other through the connecting rods. The supporting frame 21 can be installed on the connecting rods provided on two sides of the light-emitting module 1 through the positioning assembly 22.

When in use, the supporting plate 212 of the supporting frame 21 is in close contact with a flat surface. Screws are passed through the installation holes 213 on the supporting plate 212 to thereby fix the LED module 10 on the flat surface through the supporting frame 21.

Figure 6:
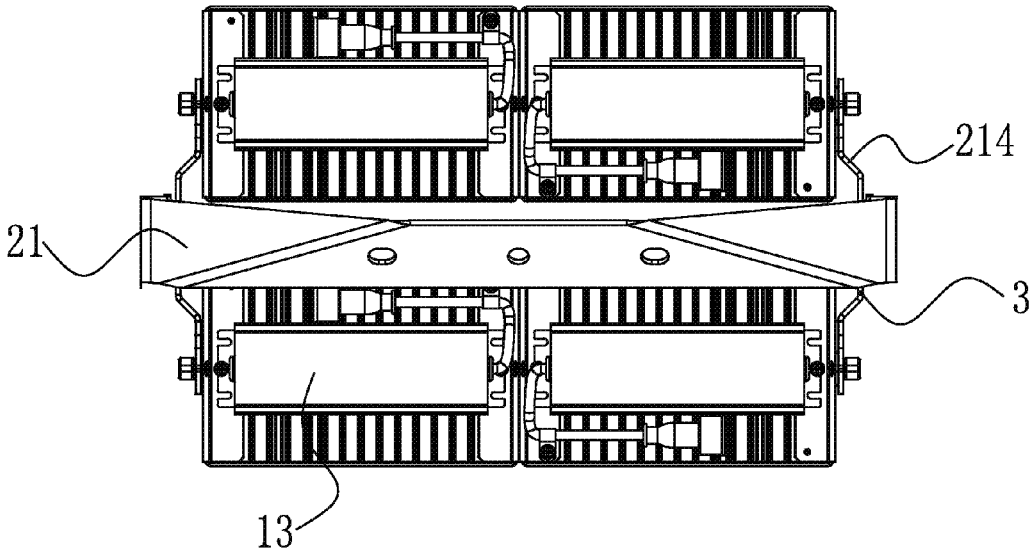
FIG. 6 is a top view of the third embodiment of the present application.
Figure 7:
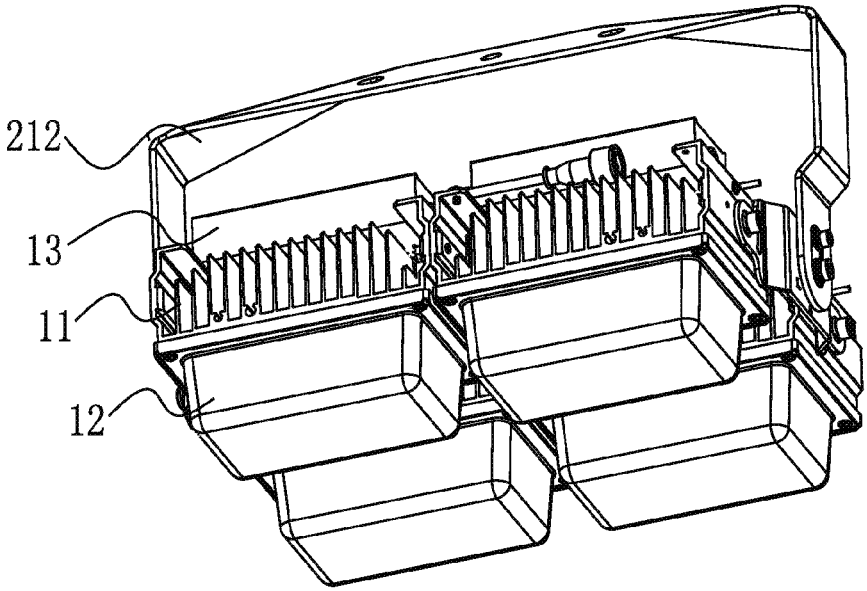
FIG. 7 is a perspective view of the third embodiment of the present application.

Third Embodiment:

FIGS. 6-7 show a multifunctional module-type light which may include a light-emitting module 1 and a supporting assembly 2. The light-emitting module 1 can be formed by combining a plurality of mutually independent LED modules 10 together. Four LED modules 10 are provided here. The four LED modules 10 can be arranged in two rows and two columns. Rows of the LED modules 10 can be connected by the connecting assembly 3, and columns of the LED modules 10 can be connected by the driving device 13 provided on the heatsink 11. The supporting plate 212 may have a slanted surface.

Figure 8:
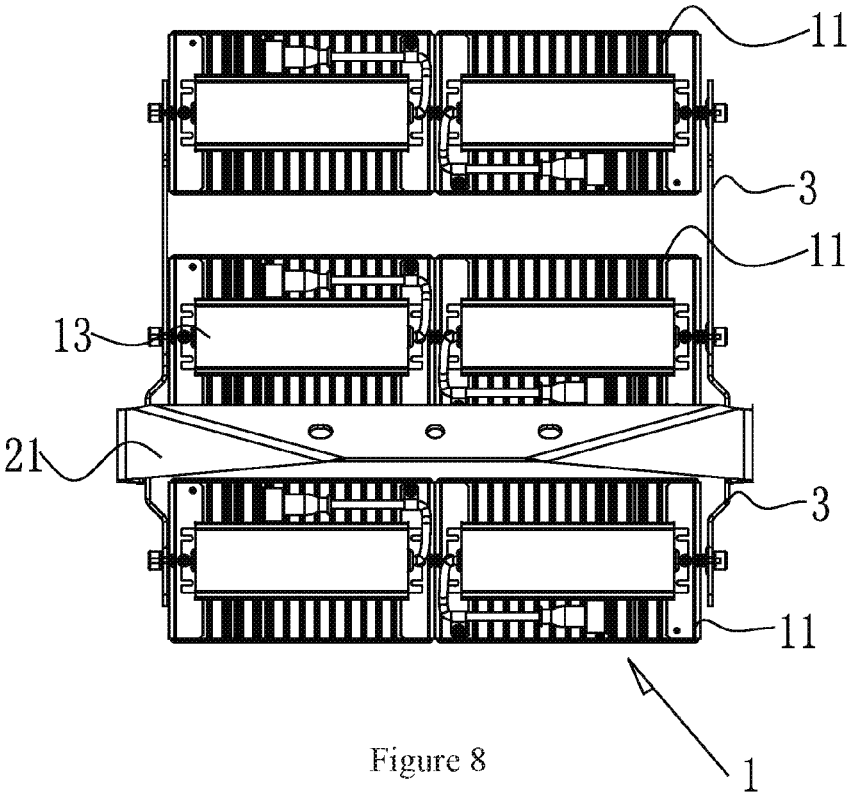
FIG. 8 is a top view of the fourth embodiment of the present application.
Figure 9:
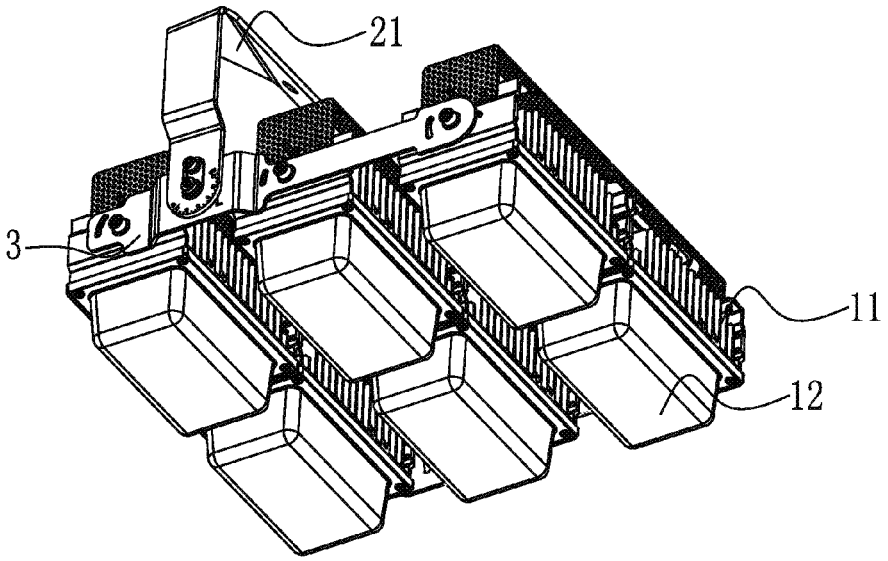
FIG. 9 is a perspective view of the fourth embodiment of the present application.
Figure 10A:
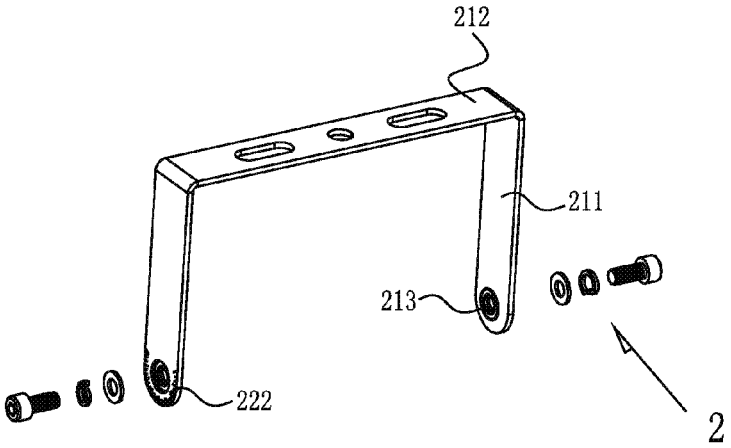
FIG. 10A is a perspective view of the supporting assembly of the first and second embodiments of the present application.
Figure 10B:
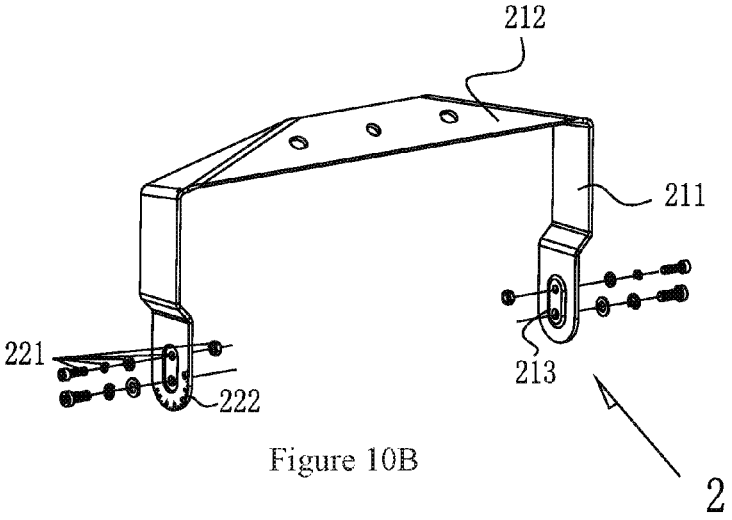
FIG. 10B is a perspective view of the supporting assembly of the third and fourth embodiments of the present application.

Fourth Embodiment:

FIGS. 8-9 show a multifunctional module-type light which may include a light-emitting module 1 and a supporting assembly 2. The light-emitting module 1 may include a plurality of mutually independent LED modules 10. Six LED modules 10 are provided here. The six LED modules 10 can be arranged in two rows and three columns. Rows of the LED modules 10 can be connected by the connecting assembly 3, and columns of the LED modules 10 can be connected by the driving device 13 provided on the heatsink 11. Each LED module 10 may include a heatsink 11, a light-transmitting cover 12 fixed on the heatsink 11, a driving device 13, and an LED light panel. The heatsink 11 may include a mounting surface and a plurality of heat-dissipating fins 111 formed on the mounting surface. Heat-dissipating channels may be formed between the heat-dissipating fins 111. Rows of the LED modules 10 can be connected with each other, and aligning heat-dissipating channels can be in communication with each other.

Specifically, the connecting assembly 3 may be in the form of a plurality of connecting rods. Rows of the LED modules 10 can be connected by the connecting assembly 3. Each connecting rod may be fixed on an outermost heat-dissipating fin 111 of the heatsink 11 on one side of each LED module 10 through a bolt. The LED modules 10 may be connected at a certain angle with respect to each other through the connecting rods. Columns of the LED modules 10 can be connected by the driving device 13 provided on the heatsink 11. Two ends of the drive device 13 can be respectively connected to the heat-dissipating fins 111 of the columns of LED module 10 by connecting pieces, so that the columns of the LED modules 10 can be connected together. The connecting rods on both sides of the light-emitting module 1 can be correspondingly connected together by connecting plates 214. The supporting frame 21 may be installed on the connecting plates 214. The positioning assembly 22 may include a positioning disk 221 formed with a plurality of positioning grooves 222, and fixed on an upper surface of the light-emitting module 1. The supporting frame 21 can be disposed across the connecting rods on both sides of the light-emitting module 1. The positioning disk 221 can be fixed on the connecting plates 214. The supporting feet 211 of the supporting frame 21 can be fixed on the connecting plates 214 through a plurality of bolts. The supporting plate 212 of the supporting frame 21 may have a slanted surface formed with installation holes 213 so that the light-emitting module 1 can be fixed on a flat surface by screws.

The operation of the present embodiment is the same as that of the first embodiment and will not be repeated here.

In order to meet different outdoor uses, the multifunctional module-type light of the present application is not only focused on lighting. It can also be used for indoor lighting, advertising lighting, regional lighting, sports facility lighting, road lighting and a variety of different outdoor locations. The light-emitting module 1 can be formed by arbitrarily combining a number of LED modules 10 together. Rows of LED modules 10 can be connected by connecting rods, and columns of LED modules 10 can be connected by driving devices 13. After connection of the LED modules 10 is completed, at least one supporting frame 21 can be mounted on the light-emitting module 1. The supporting frame 21 should be installed at a position on the light-emitting module 1 such that it can be balanced as much as possible. The number of LED modules 10 of the light-emitting module 1 can be different, and the illumination range of the light-emitting module 1 can also be different.

Specific embodiments have been described above with reference to the accompanying drawings. However, the present application is not limited to the above specific embodiments. The above specific embodiments are merely illustrative and should not be considered as limiting. It should be noted that, upon reading the above disclosure, a person skilled in the art can make various other changes or modifications without departing from the scope of the appended claims.

What is claimed is:

1. A multifunctional module-type light comprising a light-emitting module and a supporting assembly, wherein the light-emitting module comprises at least one LED module, a plurality of the LED modules being connected via a connecting assembly, the supporting assembly comprising a supporting frame and a positioning assembly, the supporting frame is installed on the light-emitting module in a manner that an angle thereof is adjustable through the positioning assembly, the supporting frame comprises two installation feet connecting with the light-emitting module and a supporting plate connecting between the two installation feet, the supporting plate comprises a flat surface or a slanted surface, the light-emitting module is fixed on a surface through the supporting plate, each LED module comprises a heatsink, a light-transmitting cover fixed on the heatsink, a driving device and an LED light panel, the heatsink comprising a mounting surface and a plurality of heat-dissipating fins formed on the mounting surface, the light-transmitting cover being formed thereon with a plurality of reflectors to meet light distribution requirements in different angles, the light-emitting module comprises one independent LED module, the support frame is disposed across the heatsink of the LED module, and the two installation feet of the supporting frame are installed on the heat-dissipating fins at two sides of the heatsink in a manner that an angle thereof is adjustable through the positioning assembly.

2. The multifunctional module-type light as claimed in claim 1, wherein the light-emitting module is formed of a plurality of LED modules parallel connected in a horizontal plane, rows of the LED modules are connected by the connecting assembly, and columns of the LED modules are connected by the driving devices provided on the heatsinks.

3. The multifunctional module-type light as claimed in claim 2, wherein the connecting assembly is in the form of a plurality of connecting rods, each connecting rod is fixed on an outermost heat-dissipating fin of the heatsink on one side of each LED module through a bolt, two ends of the drive device are respectively connected to the heat-dissipating fins of the LED module by connecting pieces, and the LED modules are connected at a certain angle with respect to each other through the connecting rods.

4. The multifunctional module-type light as claimed in claim 3, wherein the positioning assembly comprises a positioning disk formed with a plurality of positioning grooves, and fixed on an upper surface of the light-emitting module.

5. The multifunctional module-type light as claimed in claim 4, wherein the supporting frame is installed on the heat-dissipating fins of the LED module, and the positioning disk is fixed on the heat-dissipating fins, and the supporting feet of the supporting frame are fixed on the heat-dissipating fins through a plurality of bolts.

6. The multifunctional module-type light as claimed in claim 2, wherein the positioning assembly comprises a positioning disk formed with a plurality of positioning grooves, and fixed on an upper surface of the light-emitting module.

7. The multifunctional module-type light as claimed in claim 6, wherein the supporting frame is installed on the heat-dissipating fins of the LED module, and the positioning disk is fixed on the heat-dissipating fins, and the supporting feet of the supporting frame are fixed on the heat-dissipating fins through a plurality of bolts.

8. The multifunctional module-type light as claimed in claim 6, wherein the supporting frame is installed on corresponding connecting rods and the positioning disk is fixed on the connecting rods, the supporting feet of the supporting frame are fixed on the connecting rods through a plurality of bolts.

9. The multifunctional module-type light as claimed in claim 1, wherein the positioning assembly comprises a positioning disk formed with a plurality of positioning grooves, and fixed on an upper surface of the light-emitting module.

10. The multifunctional module-type light as claimed in claim 9, wherein the supporting frame is installed on the heat-dissipating fins of the LED module, and the positioning disk is fixed on the heat-dissipating fins, and the supporting feet of the supporting frame are fixed on the heat-dissipating fins through a plurality of bolts.

11. The multifunctional module-type light as claimed in claim 9, wherein the supporting frame is installed on corresponding connecting rods and the positioning disk is fixed on the connecting rods, the supporting feet of the supporting frame are fixed on the connecting rods through a plurality of bolts.

12. The multifunctional module-type light as claimed in claim 1, wherein the positioning assembly comprises a positioning disk formed with a plurality of positioning grooves, and fixed on an upper surface of the light-emitting module.

13. The multifunctional module-type light as claimed in claim 12, wherein the supporting frame is installed on the heat-dissipating fins of the LED module, and the positioning disk is fixed on the heat-dissipating fins, and the supporting feet of the supporting frame are fixed on the heat-dissipating fins through a plurality of bolts.

14. The multifunctional module-type light as claimed in claim 12, wherein the supporting frame is installed on corresponding connecting rods and the positioning disk is fixed on the connecting rods, the supporting feet of the supporting frame are fixed on the connecting rods through a plurality of bolts.

15. The multifunctional module-type light as claimed in claim 1, wherein the positioning assembly comprises a positioning disk formed with a plurality of positioning grooves, and fixed on an upper surface of the light-emitting module.

16. The multifunctional module-type light as claimed in claim 15, wherein the supporting frame is installed on the heat-dissipating fins of the LED module, and the positioning disk is fixed on the heat-dissipating fins, and the supporting feet of the supporting frame are fixed on the heat-dissipating fins through a plurality of bolts.

17. The multifunctional module-type light as claimed in claim 15, wherein the supporting frame is installed on corresponding connecting rods and the positioning disk is fixed on the connecting rods, the supporting feet of the supporting frame are fixed on the connecting rods through a plurality of bolts.

18. The multifunctional module-type light as claimed in claim 1, wherein the supporting plate of the supporting frame is formed with at least one installation hole, and is fixed on a horizontal surface by at least one screw.

* * * * *